US010424435B2

(12) United States Patent
Hamberger

(10) Patent No.: US 10,424,435 B2
(45) Date of Patent: Sep. 24, 2019

(54) APPARATUS FOR REDUCING A MAGNETIC UNIDIRECTIONAL FLUX COMPONENT IN THE CORE OF A TRANSFORMER

(71) Applicant: Siemens Aktiengesellschaft, Munich (DE)

(72) Inventor: Peter Hamberger, Kirchschlag bei Linz (AT)

(73) Assignee: Siemens Aktiengesellschaft, Munich (DE)

( * ) Notice: Subject to any disclaimer, the term of this patent is extended or adjusted under 35 U.S.C. 154(b) by 423 days.

(21) Appl. No.: 15/117,138

(22) PCT Filed: Dec. 17, 2014

(86) PCT No.: PCT/EP2014/078173
§ 371 (c)(1),
(2) Date: Aug. 5, 2016

(87) PCT Pub. No.: WO2015/117708
PCT Pub. Date: Aug. 13, 2015

(65) Prior Publication Data

US 2017/0213643 A1 Jul. 27, 2017

(30) Foreign Application Priority Data

Feb. 6, 2014 (EP) ..... 14154070

(51) Int. Cl.
*H01H 47/00* (2006.01)
*H01F 27/42* (2006.01)
(Continued)

(52) U.S. Cl.
CPC ..... *H01F 27/42* (2013.01); *H01F 27/28* (2013.01); *H01F 27/38* (2013.01); *H01F 29/14* (2013.01); *H01F 2029/143* (2013.01)

(58) Field of Classification Search
CPC ..... H01F 27/42
See application file for complete search history.

(56) References Cited

U.S. PATENT DOCUMENTS 3,963,978 A * 6/1976 Kelley, Jr. ..... H02J 3/1864 323/210
4,311,253 A * 1/1982 Putman ..... H02H 7/06 322/100
(Continued)

FOREIGN PATENT DOCUMENTS

| | | |
|---|---|---|
| CN | 103270561 | 8/2013 |
| DE | 27169594 | 3/1979 |
| WO | WO 2012/041368 | 4/2012 |

*Primary Examiner* — Stephen W Jackson
(74) *Attorney, Agent, or Firm* — Cozen O'Connor

(57) ABSTRACT

An apparatus for reducing a magnetic unidirectional flux component in the core of a transformer with at least three legs, in particular a three-phase transformer having at least one compensation winding per transformer leg, wherein the compensation windings are magnetically coupled to the core of the transformer, where two compensation windings are provided per leg, the first compensation windings of a leg are each electrically connected together in a first delta connection, in each case the second compensation windings of a leg are each electrically connected together in a second delta connection, the compensation windings of at least one leg have different numbers of windings, and where at least one switching unit is arranged in series with the compensation windings for phase angle control.

9 Claims, 4 Drawing Sheets

(51) Int. Cl.

| | |
|---|---|
| ***H01F 27/38*** | (2006.01) |
| ***H01F 29/14*** | (2006.01) |
| ***H01F 27/28*** | (2006.01) |

(56) References Cited

U.S. PATENT DOCUMENTS

| | | | |
|---|---|---|---|
| 5,416,458 | A | 5/1995 | Menke et al. |
| 2006/0197511 | A1 | 9/2006 | AF Klercker Alakula |
| 2010/0194373 | A1 | 8/2010 | Hamberger et al. |
| 2013/0207483 | A1 | 8/2013 | Hamberger et al. |

* cited by examiner

APPARATUS FOR REDUCING A MAGNETIC UNIDIRECTIONAL FLUX COMPONENT IN THE CORE OF A TRANSFORMER

CROSS-REFERENCE TO RELATED APPLICATIONS

This is a U.S. national stage of application No. PCT/EP2014/078173 filed 17 Dec. 2014. Priority is claimed on European Application No. 14154070.8 filed 6 Feb. 2014, the content of which is incorporated herein by reference in its entirety.

BACKGROUND OF THE INVENTION

1. Field of the Invention

The invention relates to an apparatus for reducing a magnetic unidirectional flux component in the core of a transformer having at least three limbs, in particular a three-phase transformer, comprising at least one compensation winding per limb of the transformer, where the compensation windings are magnetically coupled to the core of the transformer.

The area of application of the invention in principle relates to transformers in the low or medium voltage range, as well as very high power transformers (power transformers, HVDCT (high voltage DC transmission) transformers).

2. Description of the Related Art

In the case of electrical transformers, as used in power distribution grids, a direct current may undesirably be fed into the primary winding or secondary winding. This type of direct current feed, also called a DC component, may be caused, for example, by electronic components, as used nowadays to activate electrical drives or in reactive power compensation. Another cause could be "geomagnetically induced currents" (GIC).

Because of solar winds, the Earth's magnetic field fluctuates, meaning that very low-frequency voltages are induced in conductor loops at the Earth's surface. In the case of long electrical power transmission lines, the induced voltage can bring about relatively large low-frequency currents (quasi-direct currents). Geomagnetically induced currents occur approximately in ten-year cycles. They are distributed evenly across all (three) phases, can reach up to 30 A per phase and discharge via the star point of a transformer. This results in considerable saturation of the core of the transformer in a half-cycle and, hence, in a strong excitation current in a half-cycle. This additional excitation has a strong harmonic component and as a result eddy current losses are caused in windings and iron parts of the transformer by the stray field with a harmonic component. This can lead to local overheating in the transformer. Furthermore, because of the large excitation requirement there is a high reactive power consumption and voltage drop. Together, this can lead to instability of the power transmission grid. In very simplified terms, the transformer behaves in a half-wave like a choke.

Hence, in the specification of transformers many power transmission companies already require 100 A direct current for the star point of the transformer.

According to WO 2012/041368 A1, an electrical voltage induced in a compensation winding is used and is utilized to compensate for the disruptive magnetic unidirectional flux component, by connecting a thyristor switch in series with a current-limiting inductor, in order to introduce the compensation current into the compensation winding. This solution works well for direct currents to be equalized in a range that is an order of magnitude smaller than geomagnetically induced currents, in other words approximately in the range below 10 A. For geomagnetically induced currents, it would be necessary to go to the medium voltage level, i.e., to the range of approximately 5 or 8 kV, and to deploy high-capacity thyristors. Because of the high power loss of such thyristors separate, cooling for the thyristors would have to be provided, so that this solution would then not be economic.

Another solution for geomagnetically induced currents is the "DC blocker" in which, in principle, a capacitor is connected into the star point of the transformer. This solution is problematic, because charging the capacitor gives rise to a displacement voltage. In addition, the displacement voltage is limited at the capacitor, so that generally it is not possible to block the entire direct current. This solution is also problematic in the event of a short-circuit in the transmission grid, and hence zero currents.

SUMMARY OF THE INVENTION

It is an object of the present invention to provide an apparatus for reducing a geomagnetically induced magnetic unidirectional flux component in the core of a transformer, in which the voltage is below a predefinable value which e.g. pertains to the "Low Voltage Directive", i.e., below 690 V.

This and other objects and advantages are achieved in accordance with the invention by an apparatus for reducing the magnetic unidirectional flux component in the core of a transformer having at least three limbs, in particular a three-phase transformer, comprising at least one compensation winding per limb of the transformer, where the compensation windings are magnetically coupled to the core of the transformer.

In accordance with the invention, two compensation windings are provided per limb, the first compensation windings of a limb are each electrically connected to one another in a first delta connection, the second compensation windings of a limb are each electrically connected to one another in a second delta connection, where the compensation windings of at least one delta connection have the following numbers of windings and N, m are natural numbers where N>m, the first compensation winding of a first limb has N+m windings, the first compensation winding of a second limb each have N windings, the first compensation winding of a third limb has N−m windings, and where for phase-fired control at least one switching unit is arranged in series with the compensation windings.

The principle of the inventive solution is again based on direct current compensation via compensation windings, in that current is selectively fed into the compensation windings, the effect of which counters the unidirectional flux component and prevents the magnetization of the core of the transformer. In other words, "back ampere turns" are introduced into the transformer, ampere turn being another term for magnetomotive force. The compensation current is introduced into the compensation windings by a switching unit, where one compensation winding must be provided per phase or limb of the transformer core and inventively two compensation windings are provided per phase or limb of the transformer core.

The compensation windings of a delta connection have different numbers of windings. As a result, the boundary potential of the delta connection intentionally does not add up to zero, but the stopped boundary potential can be set by the parameter m so that it lies below a particular value, e.g., below 690 V. The effective number of windings N can in principle be selected to be as large as desired; only the dielectric strength in the transformer need be taken into consideration.

In phase-fired control, the phase of the voltage induced in the compensation windings is detected and the switching unit is activated such that a pulsating direct current is fed into the compensation windings, as already shown in WO 2012/041368 A1.

In an embodiment of the invention, two delta connections with a different number of compensation windings in each case, i.e., the compensation windings have the following number of windings and N, m are natural numbers where N>m, the first compensation winding of a first limb has N+m windings, while the second compensation winding of the first limb has N−m windings, the first and the second compensation winding of a second limb each have N windings, and the first compensation winding of a third limb has N−m windings, while the second compensation winding of the third limb has N+m windings.

In other words, both the compensation windings of a limb together always have the same number of windings, but they are not evenly distributed across both the compensation windings in the case of two out of three limbs. All compensation windings of a delta connection also have the same total number of windings, except that the number of windings is not evenly distributed across the limbs.

In this embodiment, it is advantageous if first and second delta connections are not electrically connected to one another, but each delta connection has its own switching unit.

In an embodiment of the invention, two delta connections are nested in one another, where the compensation windings have the following number of windings and N, m, M are natural numbers where N>m, the first compensation winding of a first limb has N+m windings, while the second compensation winding of the first limb has M windings, the first compensation winding of a second limb has N windings, the second compensation winding of the second limb has M windings, and the first compensation winding of a third limb has N−m windings, while the second compensation winding of the third limb has M windings.

In this embodiment of the delta connections nested together, first and second delta connections are connected electrically in series and have a shared switching unit.

For all switching units, in an embodiment, at least one current-limiting inductor is arranged electrically in series with the switching unit. Connecting a current-limiting inductor (inductor) in series in this way enables transient voltages to be effectively filtered out.

To determine the necessary compensation current, the switching unit can be connected to a measurement device for detecting the magnetic unidirectional flux component in the transformer. Such measurement devices are known, for instance, from WO 2012/041368 A1 in the form of a magnetic shunt component with a sensor coil. The shunt component can be arranged on the core of the transformer, e.g., resting on a limb or on the yoke, in order to route some of the magnetic flux into a bypass. From this magnetic flux, routed in the shunt, it is easily possible via a sensor coil to obtain a sensor signal with long-term stability which, where appropriate, maps the unidirectional flux component (CD component) very well following signal conditioning.

For the performance of the phase-fired control a control unit can be provided for the switching unit, where the control unit comprises a timer that is connected to a phase detector such that the timer can be triggered by the phase detector, which can detect the phase of the voltages induced in the compensation windings and can activate the switching unit such that a pulsating direct current is fed into the compensation windings. The control unit would then also be connected to the measurement device for detecting the magnetic unidirectional flux component in the transformer.

It is also an object of the invention to provide a corresponding method for operating an apparatus with a control unit comprising a timer which is triggered by the phase detector, which detects the phase of the voltages induced in the compensation windings and activates the switching unit such that a pulsating direct current is fed into the compensation windings.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

To further explain the invention reference is made in the following part of the description to the figures, from which further advantageous embodiments, details and developments of the invention can be taken, in which figures.

DETAILED DESCRIPTION OF THE EXEMPLARY EMBODIMENTS

Figure 1:
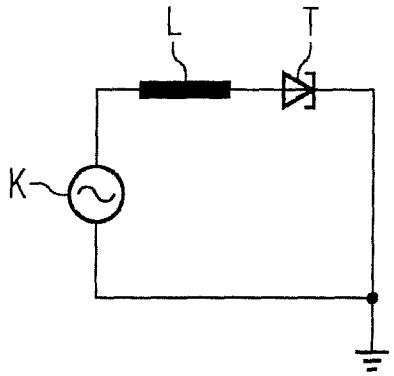
FIG. 1 shows a basic conventional circuit for introducing compensation current into a compensation winding, comprising a thyristor circuit.

With reference to the prior art circuit shown in FIG. 1, direct current is selectively introduced into a compensation winding K in the case of "direct current compensation", in order to cancel out the direct current magnetization of the transformer core. To introduce the necessary magnetomotive force (the "direct current-ampere turns") into the compensation winding K, use is made of the alternating voltage induced in the compensation winding K, where the compensation winding K acts as an alternating voltage source. At the compensation winding K, a switching unit T designed as a thyristor is connected in series to a current-limiting inductor L. The necessary direct current can be set by voltage-synchronous firing at a particular firing time of the thyristor T (phase-fired control). If the thyristor is fired in the voltage zero passage, then the maximum direct current arises which, however, is overlaid by an alternating current of the amplitude of the direct current and the mains frequency. If the thyristor T is fired later, then the direct current becomes smaller but harmonic alternating currents also arise. The current path in the thyristor T is limited by a current-limiting inductor L, where the current limiting is dimensioned by the permissible thermal charge of the thyristor T.

Figure 2:
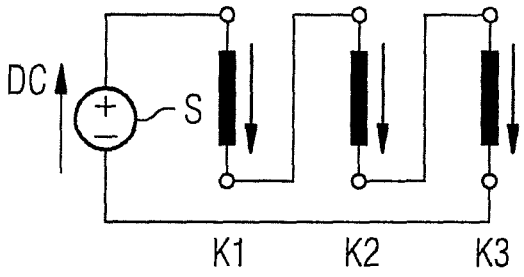
FIG. 2 shows a basic conventional circuit for introducing compensation current into compensation windings via a controllable current source.

Another conventional embodiment for reducing the magnetic unidirectional, flux component is shown in FIG. 2. Instead of the thyristor T, and in this embodiment also instead of the current-limiting inductor L, a controllable current source S is used and one compensation winding K1, K2, K3 per phase of the transformer, these being connected to one another by means of a delta connection. The controllable current source S is connected electrically in series to the compensation windings K1, K2, K3. One compensation winding K1, K2, K3 is arranged on each limb of a three-phase transformer (not shown here).

The three compensation windings at the three phases can now be connected to one another in the form of a delta connection, because the geomagnetically induced current is distributed evenly across all three phases. Hence, the same direct voltage back ampere turns must also be introduced into all three phases or into the compensation windings thereof. A delta connection of the compensation windings therefore appears expedient, because the same current must flow through all of them and the boundary potential (the total of all partial voltages of a boundary or mesh in an electrical grid) add up in an ideal symmetrical current network (without any zero components) to zero.

Use could now be made of the boundary potential of zero to introduce the direct voltage back ampere turns via a controllable current source S. However, if the transformer is not symmetrically charged, then the partial voltages of the boundary potential do not add up to zero and a reactive power must be applied by the current source S. This power for the current source S must be supplied from other sources.

By modifying the apparatus from FIG. 2, i.e., by two inventive delta connections, the principle of direct current compensation according to FIG. 1 can, however, be used again and the current source S thereby eliminated.

Figure 3:
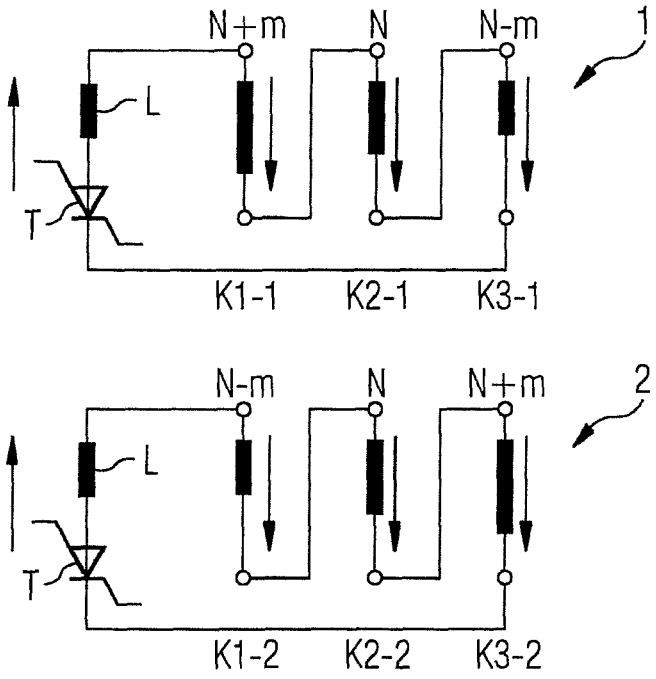
FIG. 3 shows a circuit with compensation windings in two separate delta connections in accordance with the invention.

A first embodiment of the invention is illustrated in FIG. 3 for a three-phase transformer. Two compensation windings K1-1, K1-2; K2-1, K2-2; K3-1, K3-2 are provided per limb or phase of the transformer. One compensation winding K1-1, K2-1, K3-1 of a limb is always selected and is electrically connected together to another of the other limbs in a first delta connection 1. The respective other compensation winding K1-2, K2-2, K3-2 of a limb is electrically connected together in a second delta connection 2 to the respective remaining compensation windings K1-2, K2-2, K3-2 of the other limbs.

The first and second delta connection 1, 2 are not electrically connected to one another; each delta connection 1, 2 has its own switching unit T with a series-connected current-limiting inductor (inductor) L.

The compensation windings K1-1, K1-2; K2-1, K2-2; K3-1, K3-2 are generally embodied identically, in other words with the same conductor cross-section and the same winding diameter, but in part with a different number of windings. In this case, the compensation windings have the following number of windings, where N, m are natural numbers where N>m, the first compensation winding K1-1 of a first limb (of a first phase) has N+m windings, while the second compensation winding K1-2 of the first limb (of the first phase) has N−m windings, the first and the second compensation winding K2-1, K2-2 of a second limb (of the second phase) each have N windings, the first compensation winding K3-1 of a third limb (of the third phase) has N−m windings, while the second compensation winding K3-2 of the third limb (of the third phase) has N+m windings.

The partial voltages of the boundary potential in both delta connections intentionally thus do not add up to zero, which again means phase-fired control can be used. The resulting (stopped) boundary potential can be set by the parameter m such that it falls below 690 V and the inventive apparatus falls under the Low Voltage Directive. However, the effective number of windings is N and can in principle be selected to be as large as desired. Here, only the dielectric strength in the transformer need be taken into consideration. There is no need for any externally supplied power, and any zero components that occur would not upset the inventive apparatus.

Figure 4:
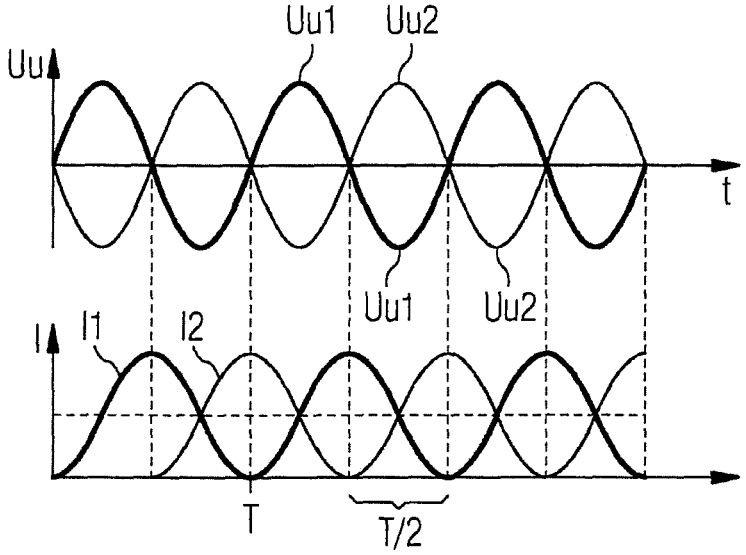
FIG. 4 shows voltage and current path in the delta connections of FIG. 3.

A further advantage of the embodiment depicted in FIG. 3 is that the boundary potential Uu1 in the first delta connection 1 is mirror-inverted to the boundary potential Uu2 in the second delta connection 2, as can be seen in FIG. 4. In the top illustration, the path of the boundary potential Uu is represented over time t. The boundary potentials Uu1, Uu2 are not only precisely mirror-inverted, but are also the same size in each case.

If the switching unit T embodied as a thyristor in the second delta connection 2 from FIG. 3 is now fired, then a half-period T/2 later than the thyristor T in the first delta connection 1, the same direct current component is produced, but the overlaid alternating voltage is mirror-inverted. The result is a reduction in the harmonic components, and the harmonic component introduced into the power grid is reduced. The path of the compensation current I over time t can be seen in the bottom illustration in FIG. 4, where I1 designates the compensation current of the first delta connection 1, and I2 designates the compensation current of the second delta connection 2. The dotted horizontal line is the effective compensation current of both delta connections 1, 2.

Figure 5:
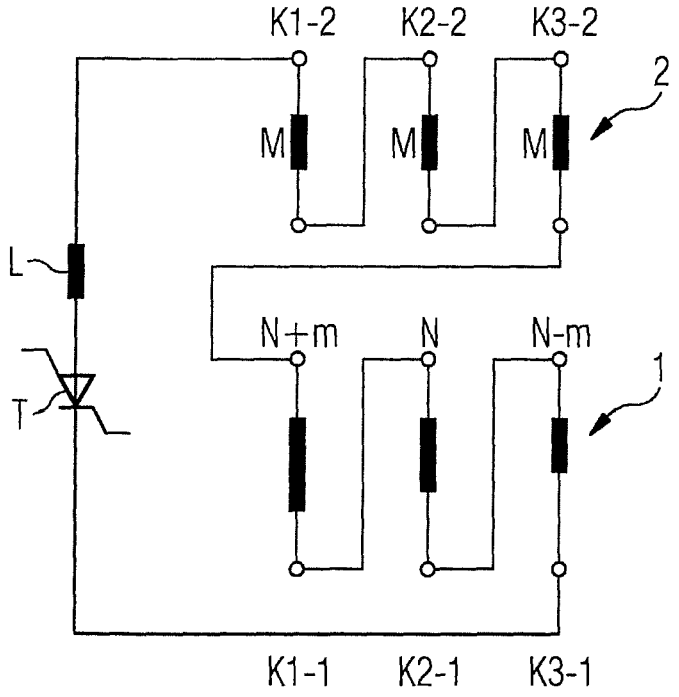
FIG. 5 shows a circuit with compensation windings in two delta connections electrically connected to one another in accordance with the invention.

An improved embodiment with reduced voltage potentials in the compensation windings is illustrated in FIG. 5. Thanks to the delta connections 1, 2 connected to one another, the partial voltages in each delta connection add up to zero. The first and second delta connection are electrically connected in series, in that the output of the first compensation winding K1-1 of the first limb is electrically connected to the input of the second compensation winding K3-2 of the third limb. The input of the first compensation winding K3-1 of the third limb is connected to the switching unit T which is common to both delta connections 1, 2, and likewise the output of the second compensation winding K1-2 of the first limb. A current-limiting inductor (inductor) L is also connected in series to the switching unit T here.

The compensation windings have the following number of windings, where N, m, M are natural numbers where N>m and, in this case, M<N, the first compensation winding K1-1 of a first limb (of the first phase) has N+m windings, while the second compensation winding K1-2 of the first limb has M windings, the first compensation winding K2-1 of the second limb (of the second phase) has N windings, the second compensation winding K2-2 of the second limb has M windings, and the first compensation winding K3-1 of a third limb (of the third phase) has N−m windings, while the second compensation winding K3-2 of the third limb has M windings.

In this case, the number of windings M in the second delta connection 2 in FIG. 5 is in this case smaller than the number of windings N in the first delta connection 1, but the number of windings M could also be the same or larger than the number of windings N in the first delta connection 1.

The partial voltages of the boundary potential across both delta connections intentionally thus do not add up to zero, which again means phase-fired control using the thyristor T can be used, as already explained in FIG. 3. The resulting (stopped) boundary potential can again be set by the parameter m such that it falls below 690 V and the inventive apparatus falls under the Low Voltage Directive. However, the effective number of windings is N for the first delta connection 1 and M for the second delta connection 2. The effective number of windings N can in principle be selected to be as large as desired; only the dielectric strength in the transformer need be taken into consideration. No externally supplied power is required, and the inventive apparatus is robust in respect of any zero components that may occur.

The arrows in FIG. 2, 3 indicate the current direction of the compensation current.

It is the case for all disclosed embodiments that when switching the switching device, i.e., when firing the thyristors T, the compensation current starts to flow. The control of the thyristors can occur in the manner disclosed in WO 2012/041368 A1. The control unit essentially consists of a phase detector and a timer. The phase detector, e.g., a zero crossing detector, deduces from the induced voltage a trigger signal that is fed to a timer. Together with a control signal likewise fed to the control unit, the control unit provides a manipulated variable on the output side which is fed to the thyristor T. The inductor L is dimensioned such that a pulsating current path flowing in a current direction is fed into the compensation winding K when the thyristor T is switched through. In this case, the thyristor T is switched at the end of the direct current pulse into the currentless state, for instance, in that the hold current of the thyristor T is undershot.

Figure 6:
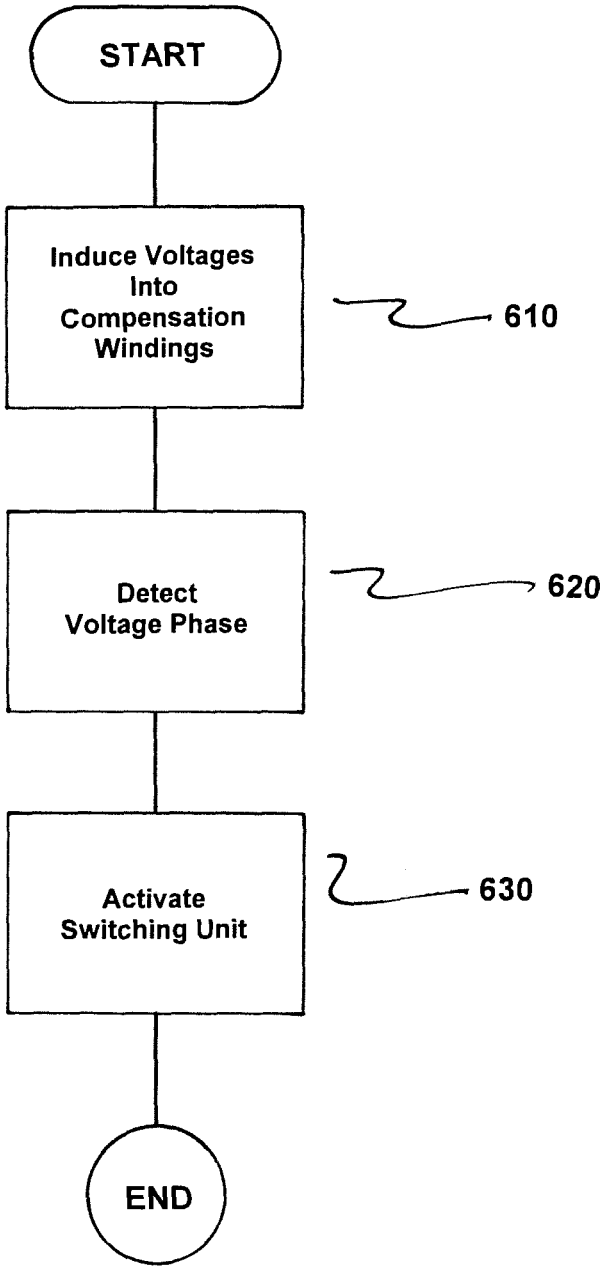
FIG. 6 is a flowchart of the method in accordance with the invention.

FIG. 6 is flowchart of a method for operating an apparatus with a control unit comprising a timer, which is triggered by the phase detector. The method comprises inducing voltages into compensation windings, as indicated in step 610. Next, the phase of the voltages induced into the compensation windings (K1-1, K1-2; K2-1, K2-2; K3-1, K3-2) is detected via the control unit, as indicated in step 620. Next, a switching unit (T) is activated by the control unit such that a pulsating direct current is fed into the compensation windings (K1-1, K1-2; K2-1, K2-2; K3-1, K3-2), as indicated in step 630.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An apparatus for reducing a magnetic unidirectional flux component in a core of a transformer having at least three limbs, comprising:

at least one compensation winding per limb of the transformer, the at least one compensation windings being magnetically coupled to the core of the transformer;

wherein two compensation windings are provided per limb, first compensation windings of a limb are each electrically connected to one another in a first delta connection, second compensation windings of the limb are each electrically connected to one another in a second delta connection;

wherein compensation windings of at least one delta connection have the following number of windings and N, m are natural numbers where N>m, the first compensation winding of a first limb having N+m windings, the first compensation winding of a second limb having N windings, and the first compensation winding of a third limb having N-m windings; and wherein at least one switching unit is arranged in series with the compensation windings to provide phase-fired control.

2. The apparatus as claimed in claim 1, wherein the compensation windings have the following number of windings and N, m are natural numbers where N>m, the first compensation winding of a first limb having N+m windings, while the second compensation winding of the first limb having N-m windings, the first and the second compensation windings of a second limb each having N windings, and the first compensation winding of a third limb having N-m windings, while the second compensation winding of the third limb having N+m windings.

3. The apparatus as claimed in claim 2, wherein the first and second delta connection are electrically unconnected to one another, and each delta connection has a separate switching unit.

4. The apparatus as claimed in claim 1, wherein the compensation windings have the following number of windings and N, m, M are natural numbers where N>m, the first compensation winding of a first limb having N+m windings, while the second compensation winding of the first limb has M windings, the first compensation winding of a second limb having N windings, the second compensation winding of the second limb having M windings, and the first compensation winding of a third limb having N-m windings, while the second compensation winding of the third limb having M windings.

5. The apparatus as claimed in claim 4, wherein the first and second delta connection are electrically connected in series and have a shared switching unit.

6. The apparatus as claimed in claim 1, further comprising:

at least one current-limiting inductor arranged electrically in series with the switching unit.

7. The apparatus as claimed in claim 1, wherein the at least one switching unit is connected to a measurement device for detecting the magnetic unidirectional flux component.

8. The apparatus as claimed in claim 1, further comprising:

a control unit for phase-fired control of the switching unit;

wherein the control unit comprises a timer, which is connected to a phase detector such that the timer is triggered by the phase detector, which can detect phase of voltages induced into the compensation windings and activates the switching unit such that a pulsating direct current is fed into the compensation windings.

9. The apparatus as claimed in claim 1, wherein the transformer is a three-phase transformer.

* * * * *